United States Patent [19]

Weiler et al.

[11] Patent Number: 4,502,614

[45] Date of Patent: Mar. 5, 1985

[54] STERILIZING APPARATUS FOR AN ENCAPSULATING MACHINE

[75] Inventors: Gerhard H. Weiler, South Barrington; Paul A. Anderson, Arlington Heights; Louis T. Pagels, Hanover Park, all of Ill.

[73] Assignee: Automatic Liquid Packaging, Inc., Arlington Heights, Ill.

[21] Appl. No.: 417,533

[22] Filed: Sep. 13, 1982

Related U.S. Application Data

[62] Division of Ser. No. 222,358, Jan. 5, 1981, Pat. No. 4,353,398.

[51] Int. Cl.[3] ..... B67D 5/46

[52] U.S. Cl. ..... 222/148; 222/334; 222/389; 137/240

[58] Field of Search ..... 222/148, 389, 334; 53/167; 422/26, 292, 113, 33; 137/240–241; 141/85, 89–91

[56] References Cited

U.S. PATENT DOCUMENTS

| | | | |
|---|---|---|---|
| 3,650,678 | 3/1972 | Hansen | 137/241 X |
| 3,922,835 | 12/1975 | Reil | 53/167 |
| 4,208,852 | 6/1980 | Pioch | 53/167 |

*Primary Examiner*—Charles A. Marmor

*Attorney, Agent, or Firm*—Dressler, Goldsmith, Shore, Sutker & Milnamow, Ltd.

[57] ABSTRACT

An improved apparatus is described for the sterilization of a machine used in the formation, filling and sealing of plastic containers. A source of sterilizing agent, such as steam, is used to sterilize the various passageways, filters, and components within the machine which, if contaminated, would contaminate the liquid in the filled plastic container. Pressurized air or gas is delivered through sterilized lines having a microorganism filter. The air flowing out of each filter is sterile and free from bacteria. A series of unique, easy to sterilize, three-position, two-way valves are used to duct pressurized gas and steam to the various components. A special air drop test apparatus is used to operationally check the integrity of the filters without breaching the sterile condition of the various fluid passageways and interconnected components.

2 Claims, 8 Drawing Figures

FIG. 1
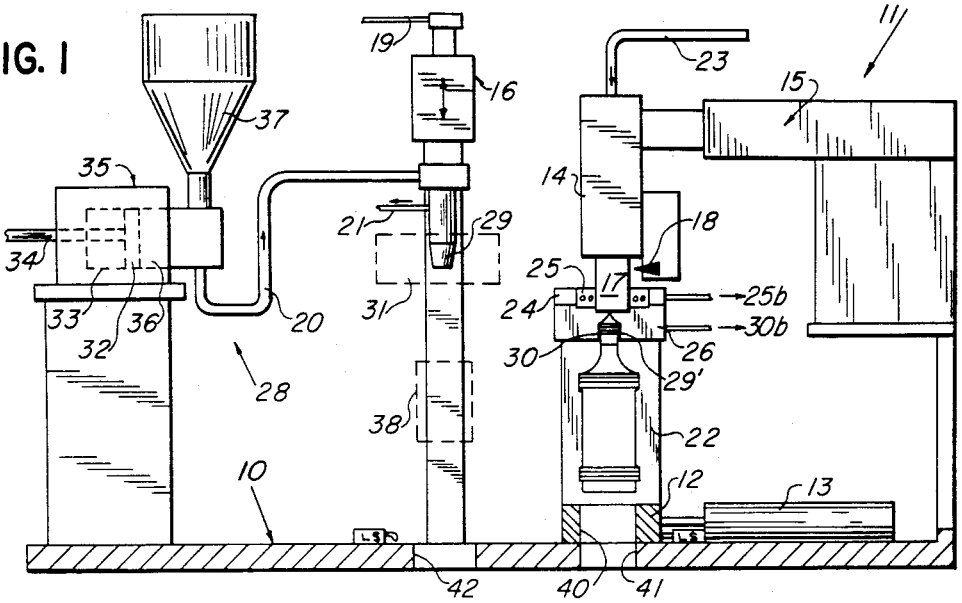
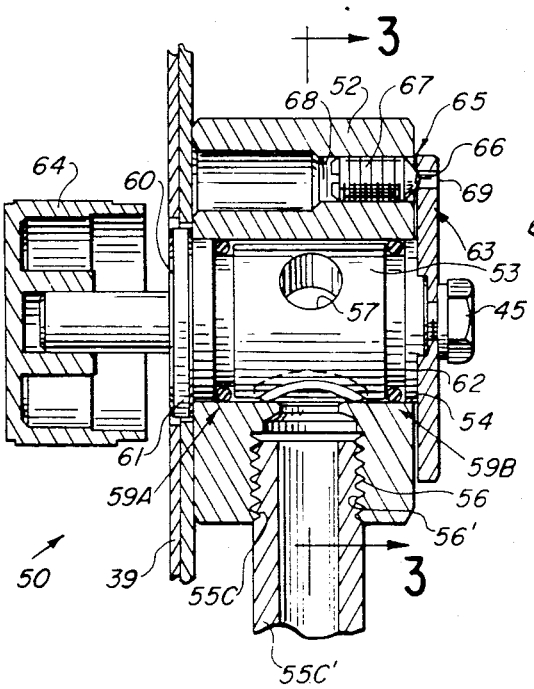
FIG. 2
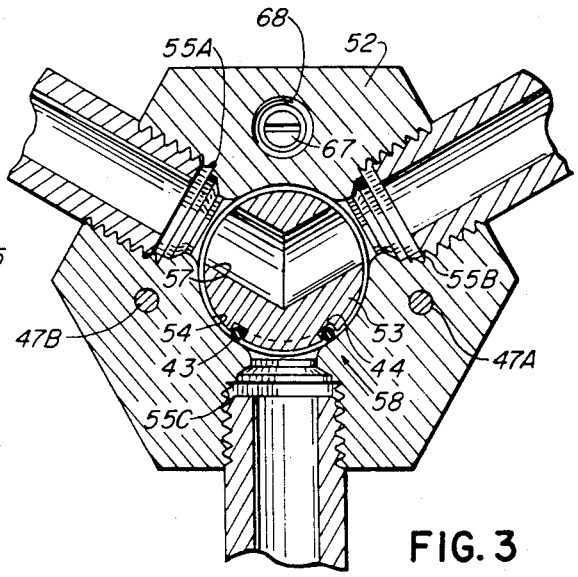
FIG. 3
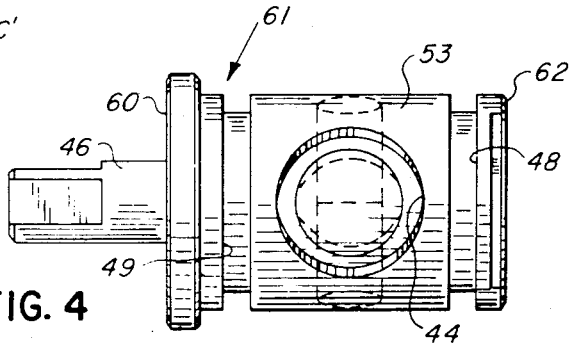
FIG. 4

STERILIZING APPARATUS FOR AN ENCAPSULATING MACHINE

This is a division of application Ser. No. 222,358, filed Jan. 5, 1981, now U.S. Pat. No. 4,353,398.

TECHNICAL FIELD

The invention concerns the apparatus used to sterilize automatic packaging machines, and particularly, those machines used in the formation, filling and sealing of containers made of a thermoplastic synthetic material.

BACKGROUND OF THE INVENTION

It is necessary in the bottling and packaging of fluids, particularly those fluids used in medicine and dentistry, that the pipe runs of the packaging machine as well as the devices used to form the container and to inject a dose of fluid into the container, are kept free of microorganisms and other contaminants. To this end a sterilizing agent such as a vapor having transferable latent heat, e.g., steam, is utilized.

The machines used for expeditious liquid packaging are devices which mold, fill and seal liquid containers in one operation. Such machines are shown in U.S. Pat. No. Re. 27,155 to Hansen and usually comprise: an extrusion head for extruding thermoplastic tubing; at least one sectional mold assembly which is arranged to enclose a length of the extruded tubing; and a nozzle assembly arranged to be introduced into the upper end of the length of tubing within the mold assembly for supplying a fluid under pressure to expand the tubing into contact with the mold and thereby form the body of the container and for filling the formed container. In addition, a metering device having inlet and outlet valves and a displacement piston is provided in conjunction with the nozzle assembly.

U.S. Pat. No. 3,650,678 to Hansen shows a typical sterilization system. Ordinary stop cocks and three-way valves are employed and the flow paths selected or utilized which are not completely touched by the sterilizing medium. Moreover, relatively complicated cam-actuated valves are used to deliver the product or filler material to and from the dosing chamber of the dosing device. These valves, while easy to clean, require the metering device to be cycled which requirement unnecessarily complicates the procedure. Most importantly, no provision is made for "on-line testing" of the bacteriological filters. Due to the nature of the sterilizing system, the sterilizing medium is often wasted and not ducted to every part of the machine which could become a potential source of contamination. Live steam can be discharged directly to the atmosphere where it is a potential personnel hazard. Finally, although some lines are sterilized prior to use, the air subsequently passing through these lines is not always filtered. The net result of these various shortcomings is that the packaging machine is not always used to its fullest advantage.

An improved apparatus or system for sterilizing the critical components of a machine used in liquid packaging applications, especially for pharmaceuticals, would be desirable and would go far to improve the utilization of those machines and to insure that the product packaged has the highest purity.

SUMMARY OF THE INVENTION

The present invention provides an improved apparatus for the sterilization of the principal components and fluid connections used in the operation of a liquid packaging machine. Typically such machines employ: a metering device having a dosing chamber defined by a shifting piston and controlled by an inlet and an outlet valve; a filling device connected to the outlet valve and having a gas feed line connected from time to time with the container produced; a source of sterilizing agent; and an extrusion head for extruding the thermoplastic in the shape of a tube.

In an apparatus embodying the present invention, piping is provided between (a) the source of the sterilizing medium or agent and the extrusion head, (b) both sides of the shifting piston within the dosing device, and (c) the gas feed line joined to the filling device. Through a manifold controlled by three-position, two-way valves, the lines to which the sterilizing medium is supplied are also connected to a source of gas, e.g., ordinarily air, under pressure. Each of these lines also includes a microorganism filter. Prior to placing the system in operation, all of the valves in lines through which the gas and product are to flow are sterilized with the sterilizing agent. In addition, an air test apparatus incorporating convenient easy to use flexible hose with quick disconnect fittings is used to check the integrity of filters. Special three-position, two-way test valves are used which can be sterilized in two steps and which can be quickly be realigned for filter testing.

One particularly unique aspect of the invention is the manner in which the shifting piston within the metering device is kept free from contamination. Specifically, once the piston rod side has been sterilized, a source of filtered air is applied at a sufficiently high pressure so as to provide a continuous air sweep or flow of air around the piston rod side of the piston. This prevents contamination from entering through the piston rod and into the dosing chamber. Finally, metering check valves are used at the inlet and the outlet of the dosing device to control the flow of product into the container produced.

Because similar components are used throughout the apparatus, the sterilizing and testing procedure is straight forward and thorough. In addition, all of the parts needed to do the job are already connected to the apparatus. Special test rigs and fittings do not have to be used. This feature also improves the cleanliness of the lines and minimizes the potential for contaminants entering the system during testing.

Numerous other advantages and features of the present invention will become readily apparent from the following detailed description of the invention and from the embodiments illustrated therein, from the claims, and from the accompanying drawings.

BRIEF DESCRIPTION OF THE DRAWINGS

FIG. 1 is a schematic, side elevation view of a machine used in the production, filling and closing of plastic containers;

FIG. 2 is a cross sectional side view of a three-position, two-way valve used when practicing the present invention;

FIG. 3 is a cross sectional plan view of the three-position, two-way valve shown in FIG. 2 as viewed along plane 3—3;

FIG. 4 is an enlarged exterior view of the valve plug shown in FIG. 2;

DETAILED DESCRIPTION

Figure 5:
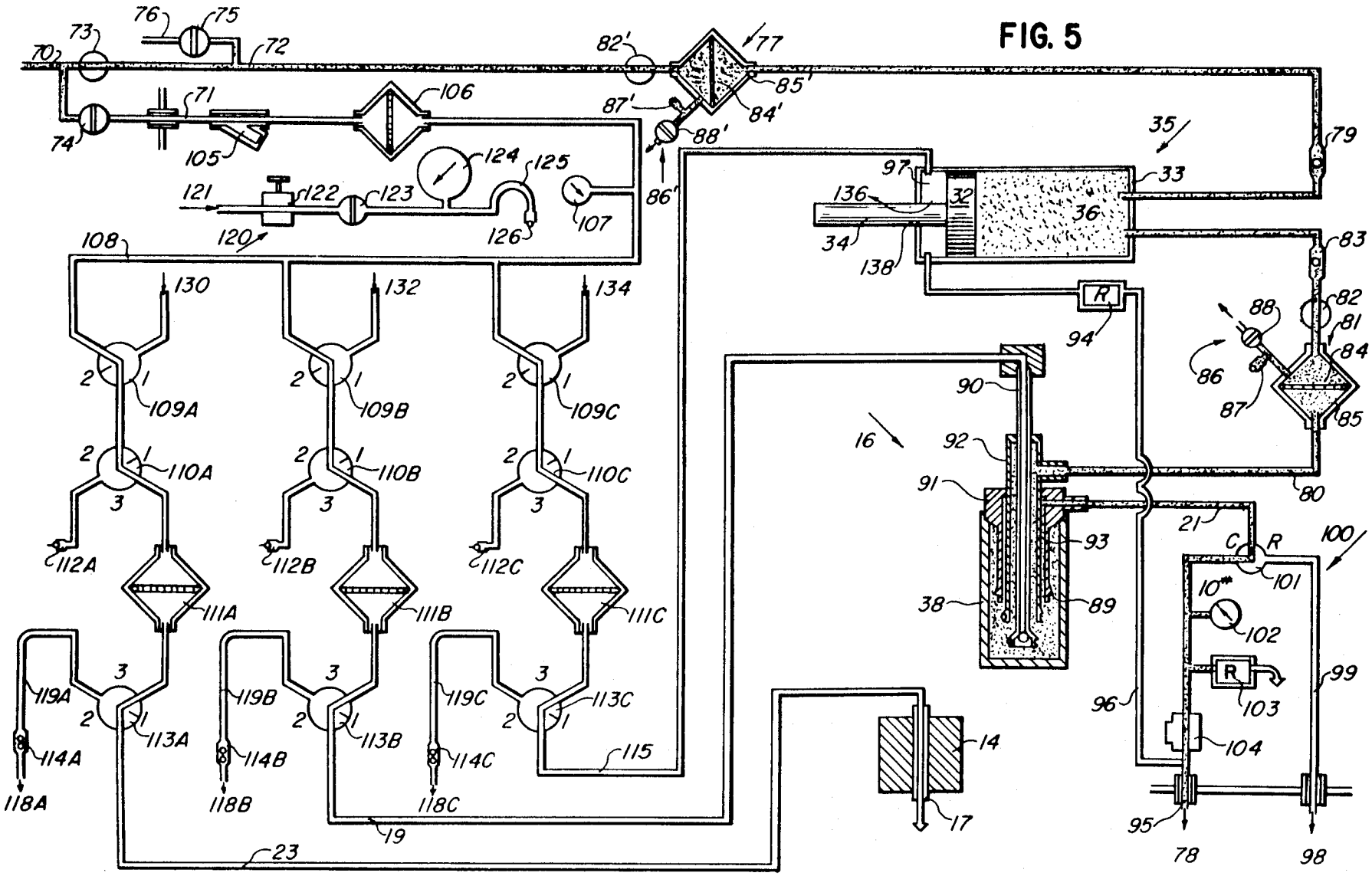
FIG. 5 is a schematic diagram of the principal components of the present invention incorporated into a machine of the general type illustrated in FIG. 1, showing the path taken by steam in sterilizing the flow path of the liquid to be packaged.

While this invention is susceptible of embodiment in many different forms, there is shown in the drawings, and will herein be described in detail, one specific embodiment with the understanding that the present description is to be considered as an exemplification of the principles of the invention and is not intended to limit the invention to the specific embodiment illustrated.

Referring to FIG. 1, a packaging machine 11 is used for the forming, filling and sealing of containers made from thermoplastic material. The principal components of the liquid packaging machine 11 are assembled on frame 10. In particular, a slide block or carriage 12 is mounted on frame 10 and is movable by a hydraulically or pneumatically operated piston and cylinder unit or actuator 13 from a position below an extrusion head 14 of an extruder 15 to a position below a hollow filling nozzle or device 16 also secured to the base 10.

The carriage 12 carries a mold assembly which includes two lower mold halves transversely displaceable relative to the direction of movement of the piston and cylinder unit 13. For purposes of clarity, only one such half, designated by 22, is shown in the drawing. Each lower mold half 22 has associated therewith a holding jaw 24 which includes a vacuum chamber therein. The vacuum chamber is provided with a plurality of suction orifices 25 joined to a source of vacuum **25*b* on the side adjacent to the plastic tube or parison 17 extruded by extruder 15. An upper mold part or half 26 slides atop the lower mold part or half 22 and is used to produce the container closure. The upper mold half 26 and the lower mold half 22 are individually displaceable by means of pneumatic or hydraulic actuators (not shown) transversely located relative to the plane of the drawing. The upper mold half 26 is located between the holding jaw 24 and the lower mold half 22. The upper mold half 26 is connected to a source of vacuum 30*b* in the same way as the holding jaw 24. A plurality of suction nozzles 30 are formed around the periphery of plastic tube 17**.

The extruder 15 produces a continuous length of thermoplastic tubing or parison 17, from a material such as polyethylene, or the like. The extruder 15 is fitted with a cutter 18 which cuts off a predetermined length of plastic tubing 17 after the plastic tubing has been positioned within the mold assembly and is held by holding jaws such as jaw 24.

The filling device 16 can be raised or lowered and is connected to a line or flexible tube 19 which is in turn connected to a source of gas, e.g. air, under pressure and to a filling line 20 communicating with the filling apparatus 28 which contains a supply of a liquid with which a formed plastic container is to be filled. A line 21 for venting the container during filling is also provided. The function of these lines and the communication thereof with the sterilizing apparatus will be explained in detail hereinbelow.

The filling line or pipe 20 is connected to a metering device 35 that controls the amount of liquid to be filled in each formed container.

The filling apparatus 28 will now be described in greater detail. The metering device 35 includes a piston 32 and a cylinder 33. The piston 32 can be displaced or actuated by means of a hydraulically or pneumatically operated positioner (not shown) whose stroke may be readily adjusted. That end of the piston 32 not having the piston rod 34 together with the cylinder 33 defines the "dosing chamber" 36. The dosing chamber is connected to the filling line or pipe 20 and to a reservoir 37 containing material to be filled.

The filling device 16 is adapted to be covered at its lower end by a cup or bell 38 (FIGS. 5 through 8) during sterilization. When the filling device 16 is mated with the cup 38, the cup functions like the container produced by the two upper and lower mold halves 26 and 22. The cup 38 then connects the air line 19 and the filling line 20 with the venting line or pipe 21. The air line 19 and the filling line 20 feed in compressed air or other gas and filler material, respectively, during a normal filling operation. Both lines empty on the bottom side of the filling device 16. The venting line or pipe 21 serves as a vent path as the container formed between the two mold halves is filled.

Further details concerning the operation of the basic machine are found in U.S. Pat. No. 3,325,860 and U.S. Pat. No. Re. 27,155, both of which are incorporated by reference for purpose of such description.

Three-Way Valve

Before proceeding with a detailed discussion of the various piping, fluid transport systems, and the components used to sterilize the liquid packaging machine 11 just described, the unique three-position, two-way valve used in the apparatus will be described in detail. Referring to FIG. 2, three-position, two-way valve 50 is constituted by two major components: a valve body 52 and a valve plug 53. The valve body 52 is a generally cylindrical casting having a central axial bore 54 and defines three evenly spaced radial openings or valve ports 55A, 55B and 55C. These valve ports direct fluid between the central axial bore 54 and the exterior of the valve body 52. The valve body 52 defines for each of the valve ports 55A, 55B, and 55C a fluid line connection means or pipe connection means 56 (illustrated in FIG. 2 for only port 55C). Typically, such pipe connection means 56 is a part of the port having a generally cylindrical configuration with conventional internal helical threads for being threadingly engaged with an externally threaded pipe that can be connected thereto, such as pipe 55C' shown in FIG. 2, and that has a complementary set of threads 56'.

The valve plug 53 fits within the central axial bore 54 of the valve body 52. The valve plug 53 defines a central radial or arcuate opening 57 (FIG. 3). The two ends of the radial opening 57 are positioned in relationship to the three valve ports 55A, 55B and 55C within the valve body 52 such that when the valve body and the valve plug are joined together the radial opening aligns with any two of the three valve ports. The valve body 52 is provided with several threaded bores 47A and 47B to facilitate mounting the valve 50 on a control panel or board 39.

A port sealing means 58 is carried by the valve plug 53 on its periphery. The port sealing means 58 seals the interface (an annulus) between the valve plug 53 and the valve body 52 adjacent the valve port not joined to or aligned with the radial opening 57. Thus, when the valve body 52 and the valve plug 53 are joined together, the fluid flowing through the aligned valve ports (any two of 55A, 55B and 55C) and the radial opening 57 is in fluid communication with the inside of the valve body and the outside surface of the valve plug with the exception of that portion of the interface between the valve body and the valve plug bordered by the outside periphery of the port sealing means 58. In other words, the entire interface between the valve body 52 and the valve plug 53 is "wetted" or immersed in the fluid passing through the valve 50 with the exception of the relatively small portion of the interface isolated by the port sealing means 58. This unique feature has particular use and application in the sterilizing apparatus to be described in detail hereinbelow. For the present, it is sufficient to say that when a sterilizing agent such as steam is flowing through valve plug 53 then a relatively large portion of the interface between the valve body 52 and the valve plug is exposed to the sterilizing agent. Furthermore, if the valve plug 53 is then realigned such that the previously covered valve port (element 55C in FIG. 3) is now aligned with the valve port to which the supply of sterilizing agent is connected, that portion of the valve body and valve plug interface not previously sterilized is exposed to the sterilizing agent. Thus, the entire interface between the valve body and the valve plug can be readily sterilized without having to disassemble the valve.

The two ends of the peripheral interface between valve body 52 and the valve plug 53 are sealed by a peripheral sealing means 59A and 59B. The peripheral sealing means 59A and 59B prevents fluid from flowing out of the two ends of the valve body 52. As illustrated in the drawings, peripheral sealing means can be a set of O-rings which are seated within circumferential recesses 48 and 49 at the two ends of the valve plug 53. In addition, the port sealing means 58 is an O-ring 43 carried within a circular recess 44 on the outside surface of the valve plug 53 (See FIG. 4). Other means can be used to produce this sealing function.

One end of the valve plug 53 is provided with an axial alignment means 61. As specifically illustrated in the drawings, the axial alignment means 61 (FIG. 4) is a flange integrally joined to the upper end 60 of the valve plug 53. The axial alignment means 61 insures that the axial position of the valve plug 53 matches the axial position of the three valve ports 55A, 55B and 55C defined by the valve body 52. The other end, the lower end 62, of the valve plug 53 is joined to a removable holding or retention means 63. When the valve plug 53 is positioned within the valve body 52 and the axial alignment means 61 rests along the upper edge of the valve body, the retention means 63 insures that the valve plug and valve body are held together in proper axial alignment. A handle or knob 64 is provided at one end of the valve plug 53 to change the position of the valve plug relative to the valve body 52. As illustrated in the drawings the retention means 63 is a flange keyed to the lower end 62 of the valve plug 53 and held in position by a threaded fastener 45. The knob 64 is keyed to a stem 46 integrally joined to the upper end 60 of the valve plug 53.

In order to insure that the two ends of the radial opening 57 in the valve plug 53 are properly aligned with any two of the three valve ports 55A, 55B and 55C, an indexing means 65 is provided. As specifically illustrated in the drawings, the indexing means 65 includes a spring loaded ball 66 carried at one end of a stud 67. The stud 67 is carried within a complementary threaded opening 68 in the valve body 52. The valve plug 63 is keyed to or locked together with the retention means 63 so the two are turned together by the handle 64. The retention means 63 is provided with three indentations 69 (only one being shown) which are complementary to the spring loaded ball 66. The position of the indentations is such that when the ball fits within one of these three indentations, the radial opening 57 in valve plug 53 is aligned with two of the three valve ports 55A, 55B and 55C defined by the valve body 52. Thus, fluid flow through the valve 50 is changed simply by rotating the handle 64 from a position where one of the indentations is aligned to the spring loaded ball 66 to a position where one of the two remaining indentations is aligned with the spring loaded ball. Thus, it should be apparent that the three-position, two-way valve 50 just described is easy to assemble, easy to clean, and easy to operate. Its use will be described at a later point in this discussion.

Sterilizing System Components

The major components of the apparatus used to sterilize the principal fluid paths within the liquid packaging machine 11 will now be described. A schematic diagram of the sterilizing system is presented in FIGS. 5 through 8. All four figures show essentially the same components; however the positions of the various valves, fluid passageway connections and removable fittings that form and define the fluid paths within the system are different depending on the fluid path that is being sterilized or tested.

A source 70 of sterilizing agent, in this particular case steam, is provided to cleanse and sterilize the principal flow paths. The sterilizing agent is ducted into two major flow paths. One flow path 72 is used to sterilize the liquid fill supply lines. The other flow path 71 (hereinafter referred to as the "sterilizing media supply line") is used to sterilize the lines 19, 23, 115 normally supplying air or another gas under pressure. An isolation valve 73 is used to shut off the supply of sterilizing agent 70, such as steam, from the liquid fill supply line 72. Another isolation valve 74 is used to shut off the supply of the sterilizing medium from supply line 71. Finally, a third isolation valve 75 is used to isolate the liquid fill supply 76 from the supply line 72.

The flow path through which the liquid fill is provided will now be described in detail. As previously described, the metering device 35 delivers a predetermined amount of the liquid fill to the filling device 16. The piston 32 within the metering device 35 slides within a cylinder 33. The dosing chamber 36 is defined by the cylinder 33 and the side of the piston 32 opposite that adjoining the piston rod 34. Volume of dosing chamber 36 can be varied by varying the stroke of piston 32. The dosing chamber 36 is joined to the liquid fill supply line 72 by a pipe having a prefilter 77, a prefilter isolation valve 82' upstream the prefilter, and an upsteam metering check valve 79. The dosing chamber 36 is joined to the dispensing nozzle of filling device 16 by a line or connection 80 having a postfilter or liquid fill filter 81, a liquid fill filter isolation valve 82, and a downstream metering check valve 83. The two metering check valves 79 and 83 are installed such that when the fluid within the dosing chamber 36 is pressurized by the piston 32, the upstream metering check valve 79 joined to the liquid fill supply line 72 seats while the downstream metering check valve 83 joined to the filling device 16 opens.

The two filters 77 and 81 in the liquid fill lines 72 and 80 are of similar construction. A filter cartridge or element 84, 84' fits within the body 85, 85' of the filter 81, 77. The upstream side of the filter body 85, 85' includes a vent and drain fitting 86, 86'. The vent and drain fitting is a T-connection. One end of the T-connection is provided with a quick disconnect fitting 87, 87'. The quick disconnect fitting facilitates the connection of hoses and temporary connections. The other end of the T-connection is provided with a gate valve 88, 88'. The gate valve is used to vent the filter body 85, 85' during start-up or during testing.

The fluid connections of filling device 16 will now be described in detail. The filling device 16 has three major components: a central blow tube 90; a fill tube 92 coaxially positioned around the blow tube 90; and an outer nozzle or mouthpiece 91 coaxially positioned around the fill tube 92. The annulus defined by the outside of the fill tube 92 and the inside of the outer nozzle 91 defines an air discharge duct or channel 93. The air discharge duct 93 is joined to the venting line or pipe 21 previously described. The filling device 16 is received within a steam cup or bell 38 during sterilization.

The venting line or pipe 21 is joined to a manifold 100 (hereinafter also referred to as the "condensate and relief valve manifold") that includes a selector valve 101, a pressure gauge 102, a relief valve 103 and a steam or condensate trap 104. The selector valve 101 has two positions: a "clean" position C and a "run" position R. In the clean position, the air discharge duct 93 within the filling device 16 is aligned to the steam or condensate trap 104. The steam or condensate trap 104 forms a liquid seal between the filling device 16 and the atmosphere when steam is supplied to the filling device. A pipe 95 directs the fluid to an atmospheric drain 78. The pressure gauge 102 measures the pressure in the air discharge duct 93 or within the steam cup 38 when the selector valve 101 is aligned to the clean position C. The use of the pressure gauge 102 when sterilizing the apparatus will be described at a later point in this discussion. The relief valve 103 acts as a safety valve to protect the venting line or pipe 21 from overpressurization. When the selector valve 101 is aligned to the run position R, the venting line 21 is aligned to a pipe 99 terminating in a vent orifice 98.

One other connection must be mentioned in connection with the condensate and relief valve manifold 100. The side of the piston 32 connected to the connecting rod 34 together with the cylinder 33 define an enclosed chamber or space 97. A line 96 joins the enclosed chamber to the pipe 95 discharging condensate from the steam trap 104. A relief valve 94 in this line 96 normally isolates the enclosed chamber 97 from the condensate drain pipe 95. The purpose and use of the relief valve 94 in regard to the sterilization process will be described at a later point in this specification. The relief valve 94 insures that air or other gas supplied to the piston rod side of the piston is not supplied at such a high volume or pressure that the operation of the metering device 35 will be affected.

The components in the sterilizing media supply line 71 will now be described. A strainer 105 and a steam filter 106 are located immediately downstream the steam supply isolation valve 74. The strainer removes relatively large particles from the steam supplied thereto while the steam filter removes finer particles. In one specific embodiment the steam filter 106 is a five micron cartridge filter. In contrast, the product postfilter 81 is a 0.2 micron filter. A pressure gauge 107 measures the pressure of the steam downstream of the steam filter 106. The steam flowing from the steam filter feeds a manifold or distribution pipe 108.

Three two-position plug valves 109A, 109B and 109C distribute the steam or sterilizing agent from the distribution manifold 108 to the extrusion head 14, the blow pipe 90 and the enclosed chamber 97 at the piston rod end of the dosing device 35. The three two-position valves 109A, 109B and 109C are also used to direct the flow of pressurized air or gas to the same three components. Since the air or gas supplied to the extrusion head 14 is used to prevent the plastic tube or tubing 17 from collapsing upon itself, that air or gas 130 is referred to as "balloon air." The air or gas 132 supplied to the blow tube 90 is used to expand the plastic tube 17 into the shape of the two mold parts or halves 26 and 22, and is called "blow air." Finally, the air or gas 134 supplied to the piston rod end of the piston 32 within the dosing device 35 is called "shield air" since the air is used to prevent the entrainment or the leakage of bacteria into the dosing chamber 36. This latter system will be described later. Because of the functions served, these three two-position valves 109A, 109B and 109C are called "gas selector valves".

Figure 6:
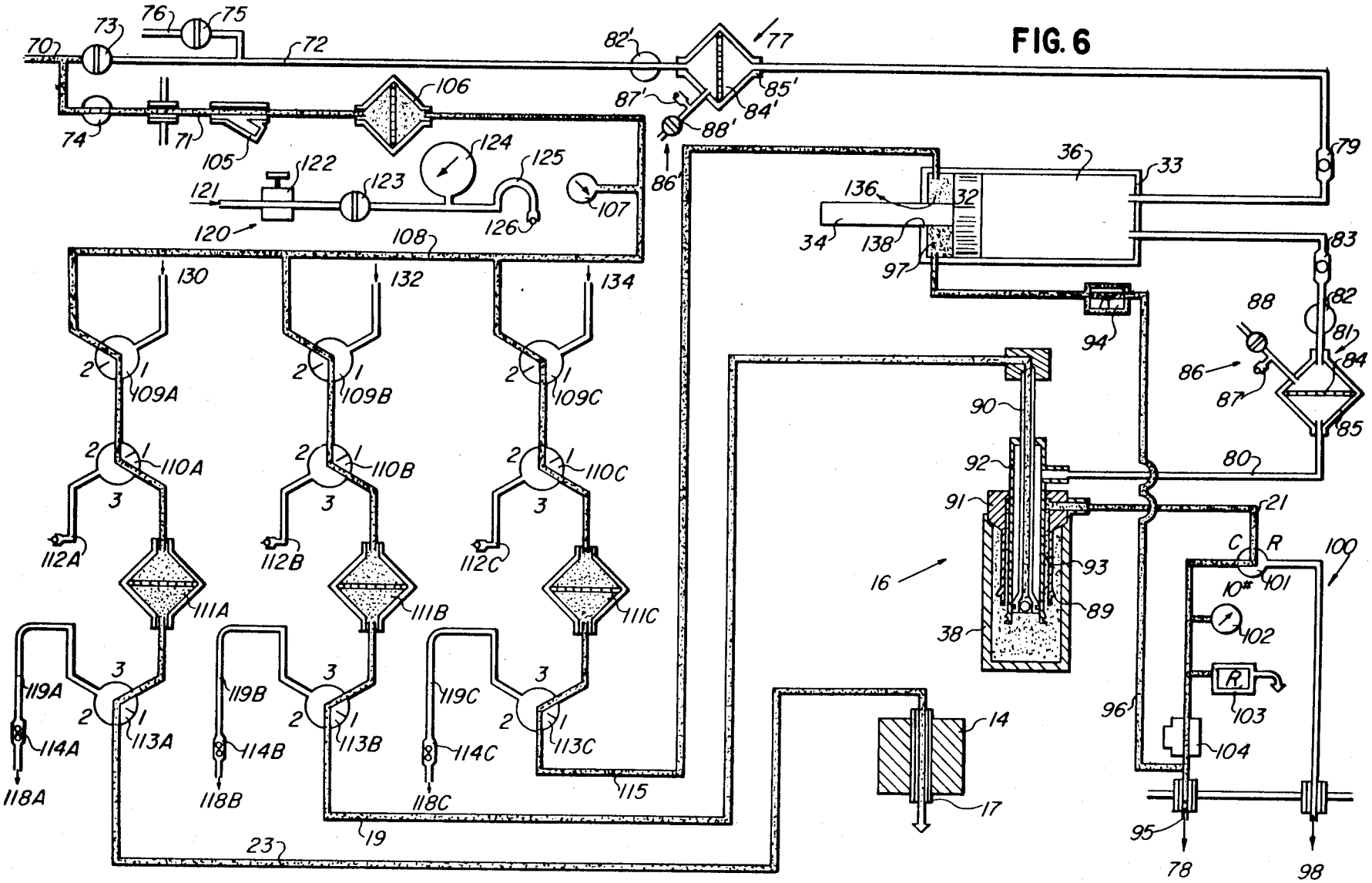
FIG. 6 is a schematic diagram of the principal components of the present invention incorporated into a machine of the general type illustrated in FIG. 1, showing the path taken by steam in sterilizing the gas filters and the flow paths normally supplied with air or gas under pressure.

Immediately downstream of each gas selector valve is an upstream bypass valve 110A, 110B, 110C. The upstream bypass valves are three-position two-way valves of the type previously described. The fluid entering the valve can be directed to one of two ports. One of the ports is joined to its respective gas filter 111A, 111B and 111C. The other port is joined to a pipe having a quick disconnect fitting 112A, 112B, 112C at its end. A downstream bypass valve 113A, 113B, 113C is joined to the other end of the respective gas filter 111A, 111B, and 111C. These filters are typically 0.2 micron cartridge filters. One of the ports on each of the three downstream bypass valves is joined to a pipe having a hose 119A, 119B, 119C with a quick disconnect fitting 114A, 114B and 114C respectively at its end much as in the case of the upstream bypass valves 110A, 110B, and 110C. Thus the upstream and downstream bypass valves have three positions: a first position where the gas selector valves 109A, 109B, and 109C are aligned with the gas filters 111A, 111B, and 111C; a second position where the gas filters are isolated; and a third position where the gas filters are aligned with the two sets of quick disconnect fittings 112A, 112B, 112C and 114A, 114B, 114C. The particular manner and the circumstances under which the upstream and downstream bypass valves are positioned in the second and third positions will be described in detail at a later point in this discussion. When the gas selector valves, upstream bypass valves and downstream bypass valves are aligned to supply steam to the encapsulating apparatus the valves are positioned as shown in FIG. 6.

An air testing or air drop test apparatus 120 is provided to test the integrity of the filters. Specifically, the air drop test apparatus includes: a supply of clean air 121; a test air regulator 122; a shut-off valve 123; a test air gauge 124; and a flexible test hose 125 having a quick disconnect fitting 126 at its end. When the supply of clean air 121 is directed into the flexible hose 125 by opening the shut-off valve 123, a source of regulated clean air under pressure is available. The pressure of the air flowing from or out of the quick disconnect fitting 126 is set by adjusting the air regulator 122 and observing the test air gauge 124. How the apparatus is used in relationship to testing the three filters 111A, 111B and 111C will be described in detail in the discussion following.

Preoperational Testing

Prior to placing the liquid packaging machine 11 into operation, the apparatus must be sterilized. Various sterilizing agents or mediums may be used. A steam generator producing steam at 125 degrees C. and at a pressure of approximately 1 ½ atmospheres has been found to work particularly well. Prior to applying steam to liquid packaging machine 11 the following valve line-up is performed: referring to FIG. 5, the product supply isolation valve 75 is shut; the steam supply isolation valve 73 for the product supply line 72 is shut; and the steam supply isolation valve 74 to the sterilizing media supply line 71 is shut. Next, the blow tube 90 is verified to be in the down position where it is exposed to the interior of the steam cup 38 and to the product line 80 joined to the fill tube 92. The selector valve 101 at the condensate end relief valve manifold 100 is positioned to the "clean" position C. The gas selector valves 109A, 109B and 109C are aligned to the second position. The upstream bypass valves 110A, 110B and 110C and the downstream bypass valves 113A, 113B and 113C are aligned to the first position (i.e. aligned to the gas filters 111A, 111B, and 111C). The filter bypass hoses 119A, 119B, and 119C are aligned to or connected with the filter drain lines 118A, 118B, and 118C. In addition, the test air isolation valve 123 is checked to be in the shut position. Finally, the product filter vent valves 88 and 88' and the product filter drain valves or fittings 87 and 87' are opened. This completes the initial valve line-up of the system.

The next step is to apply sterilizing steam to the product lines. This is accomplished by opening the isolation valve 73 between the steam supply 70 and the product supply line 72. Once steam is observed to be flowing freely through the product filter vent valves 88 and 88' and drain valves 87 and 87', the product filter vent valves and drain valves are shut. Steam then flows from the steam supply 70 through the two product filters 77 and 84, through the dosing chamber 36 and to the fill tube 92 where the steam cup 38 diverts the steam through the evacuation line 21 to the condensate and relief valve manifold 100. Typically, the steam supply 70 is adjusted to provide a continuous flow of steam for a minimum of thirty minutes. During this period the pressure gauge 102 at the condensate end relief valve manifold 100 is observed. A pressure of about ten pounds should be maintained during the steaming period. Once the product lines have been heated for the requisite time period, the isolation valve 73 supplying steam to the product supply lines 72 is shut. The product lines have been effectively sterilized by this operation.

The next step is to sterilize the air or gas supply lines (See FIG. 6). This is accomplished by opening the isolation valve 74 between the steam supply 70 and the sterilizing media supply line 71. During this process the fill tube 92 is raised. Steam is then supplied to the distribution manifold 108 where it is directed to the extrusion head 14, the blow tube 90 and closed chamber or space 97 at the piston rod side of the dosing device 35. During this steaming process, steam flows through: the gas selector valves 109A, 109B, 109C; the upstream bypass valves 110A, 110B and 110C; the three gas filters 111A, 111B and 111C; the three downstream bypass valves 113A, 113B and 113C, and the respective downstream piping 23, 19, and 115. These lines are steamed for a minimum of fifteen minutes while maintaining a pressure of ten pounds at the pressure gauge 102 or the condensate and relief valve manifold 100. Steam should be applied for at least fifteen minutes.

It should be noted that the filling device 16 has been "steamed" during the sterilization of the product lines and during the sterilization of the gas supply lines. Steam is applied to the interior of the cup 38 by two paths. Steam flows into the interior of the cup from the pipe 80 joined to the fill tube 92 and from the air line 19 joined to the blow tube 90. Steam flows out of the cup 38 by way of the evacuation line or pipe 21 in both cases.

Figure 7:
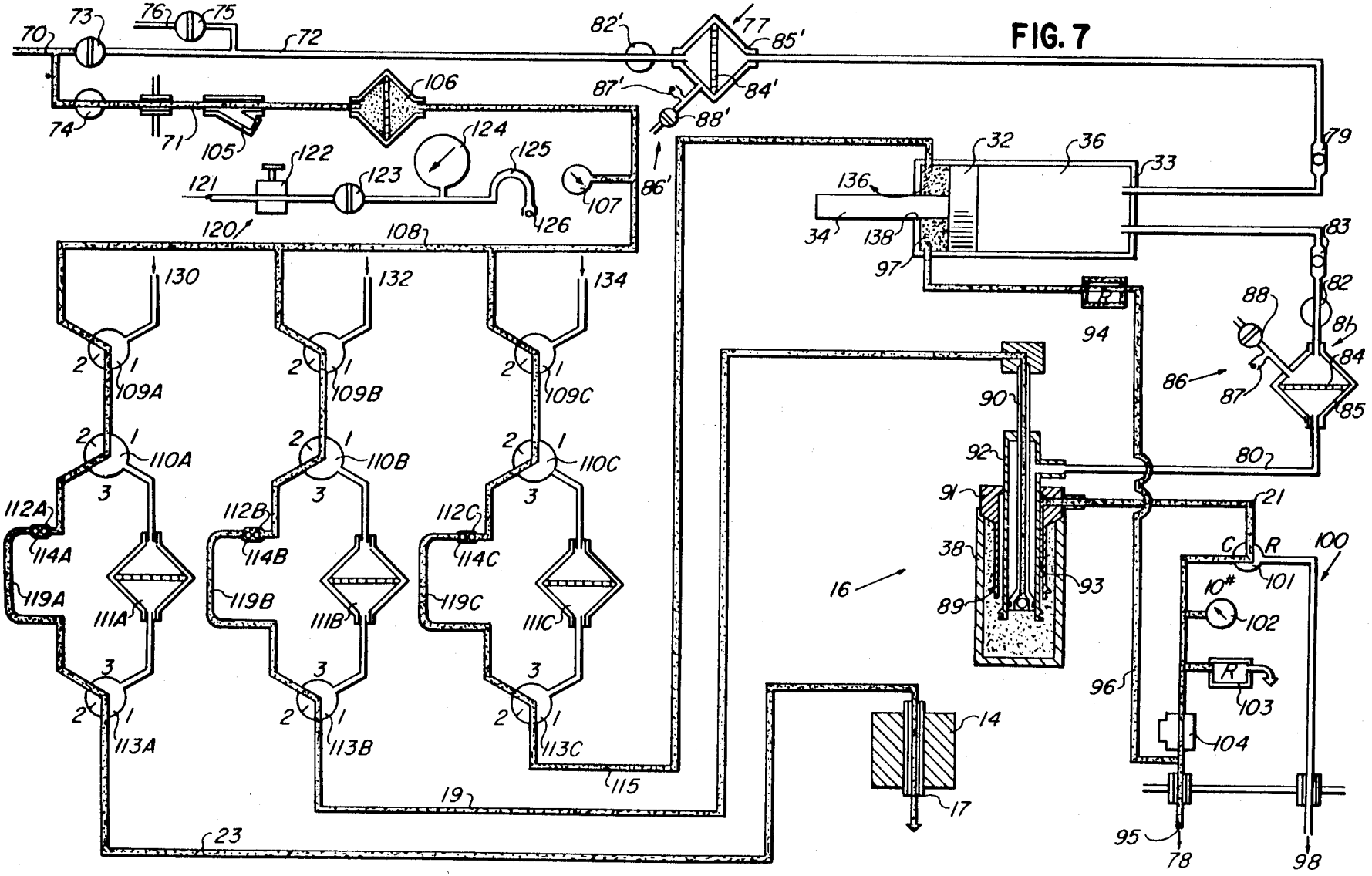
FIG. 7 is a schematic diagram of the principal components of the present invention incorporated into a machine of the general type illustrated in FIG. 1, showing the path taken by steam when bypassing the gas filters.

After the steam has flowed at the requisite pressure and for a requisite time period, the flexible bypass hoses 119A, 119B and 119C, that are joined to the downstream bypass valves 113A, 113B, 113C, are joined to the quick disconnect fittings 112A, 112B, and 112C on the respective upstream bypass valves 110A, 110B, and 110C. Next, the upstream bypass valves 110A, 110B, and 110C and the downstream bypass valves 113A, 113B and 113C are aligned to their second position or to the position where the gas filters 111A, 111B, and 111C respectively are isolated. The flow of steam with the upstream and downstream bypass valves so positioned is illustrated in FIG. 7. The steam then flows around the three gas filters 111A, 111B, and 111C. This step sterilizes that portion of the interface between the valve plug and the valve body that was not previously exposed to the hot steam. Consequently, this step completes the sterilization of all the internal components of the upstream and downstream bypass valves and the connections thereto. Again, the lines are steamed for a minimum of fifteen minutes while observing the pressure of ten pounds at the pressure gauge 102 located on the condensate and relief valve manifold 100. After these lines have been sterilized, the isolation valve 74 supplying steam to distribution manifold 108 is shut.

It should be noted that in order to insure flow through the enclosed chamber or space 97 at the piston rod side of the dosing device 35, the downstream relief valve 94 must be opened. This is accomplished by insuring that the steam supplied to the dosing device 35 via the shield air distribution valve 109C is in excess of the relief valve set point. This also insures that the normally stagnant line 96 between the relief valve 94 and the dosing device 35 is thoroughly sterilized.

Filter Testing

All that remains to be done is to verify the integrity of the gas filters 111A, 111B, and 111C and product filters 77 and 86. Conceivably, one of the filters was damaged during the high temperature steaming or sterilization process. Before checking the damage, however, certain valves must be lined up for testing. First, the selector valve 101 at the condensating relief valve manifold 100 is moved to the "run" position R. The gas selector valves 109A, 109B and 109C are moved to the first position or the position where air or gas under pressure is supplied to the upsteam bypass valves. Next, the upstream bypass valves 110A, 110B and 110C and the downstream bypass valves 113A, 113B and 113C are aligned to the third position or to the position where the gas filters 111A, 111B, and 111C are aligned to the upstream quick disconnect fittings 112A, 112B, and 112C and to the respective filter bypass hoses 119A, 119B and 119C. The filter bypass hoses are removed from the quick disconnect fittings 112A, 112B, and 112C on the upstream bypass valves 110A, 110B, and 110C to which they were joined during the previous sterilization process. The filter bypass hoses are then mated with the drain lines 118A, 118B, and 118C. The next step is to individually test each filter.

Figure 8:
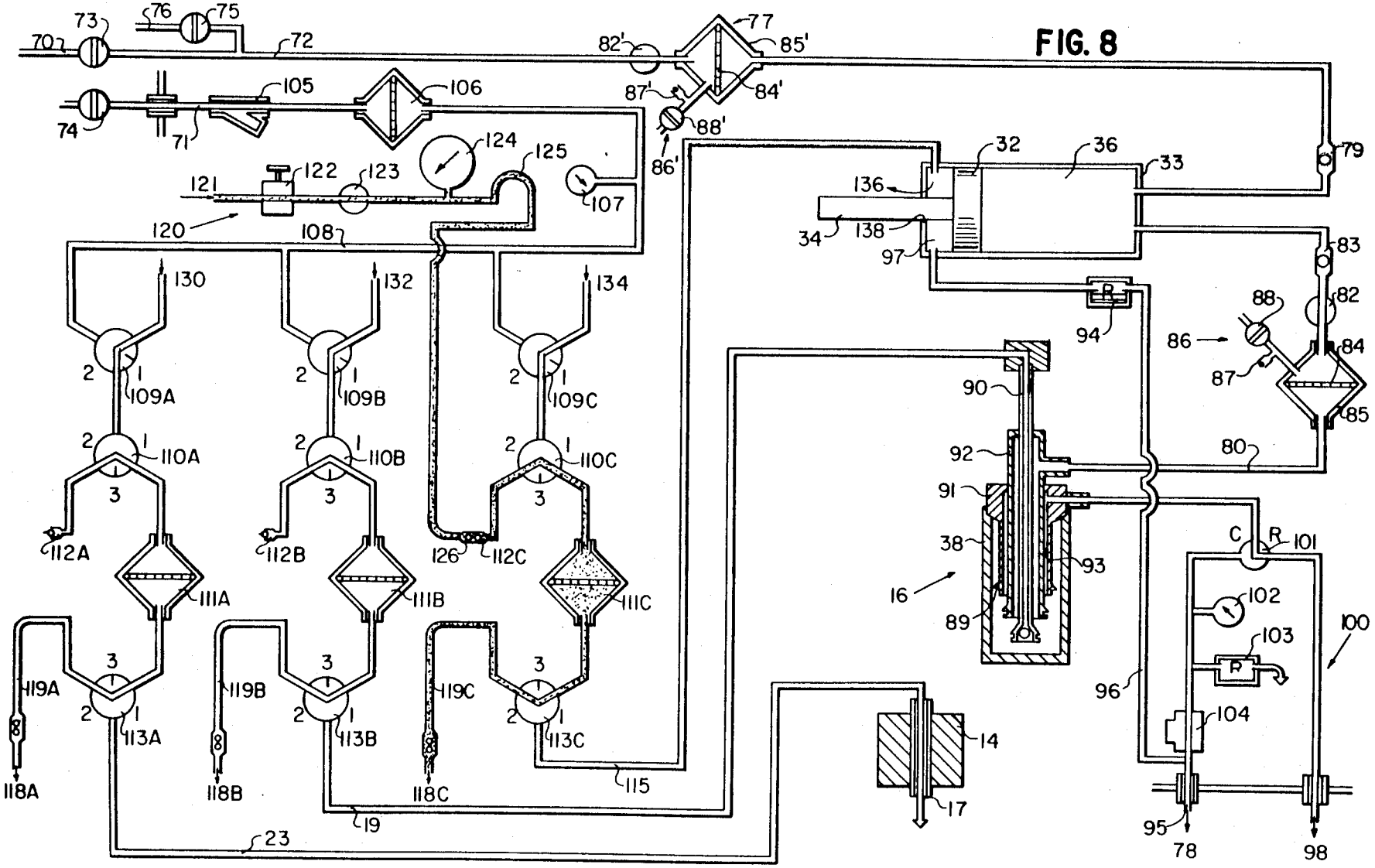
FIG. 8 is a schematic diagram of the principal components of the present invention incorporated into a machine of the general type illustrated in FIG. 1, wherein air has been manifolded to one of the gas filters to test its integrity.

Each filter is tested using the supply of clean air 121 and the air drop test apparatus 120. FIG. 8 illustrates the line-up of the system when the filter 111C joined to the dosing device 35 is ready for testing. Specifically, the flexible test hose 125 is joined to the upstream filter bypass valve 110C by joining together the two quick disconnect fittings 112C and 126. Next, the test air isolation valve 123 is opened. Using the test air gauge 124, the test air regulator 122 is adjusted to maintain the pressure that is recommended by the manufacture of the filter. This step effectively pressurizes the upstream side of the filter 111C. In order to insure that equilibrium has been achieved and that full pressure is applied to the filter and associated piping, this pressure is maintained for at least one minute. Next, the test air isolation valve 123 is shut. As soon as the valve is shut, the test air gauge 124 is carefully observed. The rate of change in pressure and the maximum pressure drop are noted. The maximum pressure drop should not exceed the filter manufacture's recommendation. If the pressure drop exceeds the maximum allowable value, this is an indication that the filter may have been damaged. If the pressure remains relatively steady and does not drop appreciably, it is reasonably certain that the filter 111C has not been damaged during the sterilization process. Thus, the integrity of the filter has been established without breaching the integrity of the sterilized piping used to supply air or gas 134 under pressure to the piston rod side of the dosing device 35. Similarly, the blow filter 111B and the balloon filter 111A are tested.

The next step is to test the integrity of the product filters 86 and 77. In each case the product filter upstream isolation valve 82, 82' are shut. Next, the flexible test hose 125 is joined to the quick disconnect fitting or valve 87, 87' on the filter 86, 77 to be tested. Just as in the case of the three gas filters 111A, 111B and 111C, the upstream side of the filter element 84, 84' is pressurized in accordance with the manufacturer's recommendation for at least one minute. Next the change in pressure is observed using the test gauge 124. If the pressure drop does not exceed the filter manufacturer's recommendation, the integrity of the filter element can be considered established. Each of the two product filters 86 and 77 is tested in a similar fashion. This test insures that the two product filters 86 and 77 have not been damaged during the sterilization process. After all of the filters have been tested and found satisfactory, the air drop test apparatus 120 is secured and the filter isolation valves 82 and 82' are returned to their normal line-up.

Operation

To operate the liquid packaging machine 11 certain valve line-ups must be performed. The isolation valve 73 between the steam supply 70 and the product supply line 72 is checked shut. Similarly, the steam supply 70 is isolated from the sterilizing media supply line 71 by shutting the isolation valve 74. Next, the gas selector valves 109A, 109B and 109C are verified in their first position, where air or gas is supplied to the three gas filters 111A, 111B and 111C. The cup 38 is removed from the end of the filling device 16. The product or filler is then supplied to the product supply line 72 by opening the isolation valve 75. If necessary, the vent valves 88 and 88' on the two product filters 81 and 77 are opened to insure that product or filler fills the various lines without leaving bubbles or voids. The product is prevented from spilling out of the filler device 16 by raising the blow tube 90 so that it closes off the open end of the fill tube 92. The next step is to supply sterilized air or gas to the piston rod side of the dosing device 35.

By pressurizing the enclosed space 97 between the piston 32, the piston rod 34, and the cylinder 33 of the dosing device 35, bacteria or other contaminated materials are prevented from entering into the dosing chamber 36 by leaking around the piston rod and the piston. The pressurized air or gas that is applied to the enclosed chamber or space 97 flows out of the space (See arrow 136) between the piston rod 34 and the opening 138 in the cylinder 33 through which the piston rod protrudes. In effect, the air or gas 134 supplied to the dosing device acts as a shield against the entry of contamination. For this reason the air or gas 134 supplied to the dosing device 35 is called "shield air."

The dosing device 35 operates in a conventional manner. Specifically, when the piston 32 is withdrawn so as to increase the volume of the dosing chamber 36, the downstream metering check valve 83 seats and the upstream metering check valve 79 opens. When the piston 32 is forced inwardly so as to decrease the volume of the dosing chamber 36 the upstream metering check valve 79 seats and the downstream metering check valve 83 opens. This provides a source of product under pressure to fill the container formed by the two mold halves.

Since the air line 19 downstream of the blow filter 111B has been sterilized and since the gas line 23 downstream of the balloon filter 111A has been sterilized, sterile air is provided to the blow tube 90 and the extrusion head 14. Thus, the mouthpiece or outer nozzle 89 of the filling device 16, during operation, at least in its position of rest, lies in a stream of sterile gas or air. On dipping into the hot tube of plastic 17, the interior of which is supplied with sterile air or gas via the gas line 23, the mouthpiece 89 is surrounded by sterile air so that unsterile air cannot come into contact with the mouthpiece.

Typically, the mouthpiece 89 of the filling device 16 is surrounded by a box or enclosure 31 (shown in phantom in FIG. 1) that is attached to a source of sterile gas or air. This prevents unsterile air from flowing in the direction of or around the outer nozzle of mouthpiece 89. A similar box or container (not shown) around the extrusion head 14 may be used to prevent contamination from entering in that area. These two devices insure that the extrusion head 14 and the outer nozzle 89, once sterilized, are not contaminated during the operation of the liquid packaging machine 11.

During the operation of the liquid packaging machine 11 the plastic tube 17 is constantly pressed out of the extrusion head 14. As soon as the plastic tube has reached the necessary length, the two halves or the lower parts 22 of the mold move together and receive the piece of tubing 17 between them. The top of the tubing 17 is held by a vacuum in the vacuum chamber 24 after it has been cut by the cutter or knife 18.

The lower mold halves or parts 22 are then repositioned by the actuator 13 to a position below the filling device 16 which is then lowered onto the lower mold halves 22. When the outer nozzle or mouthpiece 89 lowers into the two lower mold halves 22, the plastic tube 17 surrounds the outer nozzle 89. Blow air 132 is then applied through the air line 19 which presses the plastic tube 17 against the walls of the mold. Next, the product or filler material is introduced into the container by means of the dosing device 35 via the fill tube 92 which forces the compressed air or gas out of the container and into evacuation line or pipe 21. After filling the container, the filling device 16 is raised and the upper mold halves or parts 26 close to form the head of the container. On switching off the source of vacuum, the mold halves open and the filled container falls downwardly through the two openings 40 and 42 in the machine. The mold then travels back to a position below the extrusion head 14 so as to be able to receive a new piece of plastic tubing 17 whereupon the entire operating cycle just described is repeated.

From the foregoing it should be understood that sterilizing apparatus just described provides a means for effectively sterilizing those components of the liquid packaging apparatus 11 which if not properly protected could become a source of contamination. A continuous stream of sterilized air ("balloon air" 130) is provided to the inside of the plastic tube 17 by the gas line 23 entering the extrusion head 14. In addition, a constant supply of air or gas ("blow air" 132) under pressure is supplied to the blow tube 90 via the air line 19 downstream of the blow filter 111B. Finally, air or gas ("shield air" 134) is supplied to the piston rod side of the piston 32 within the dosing device 35. All three of these gas streams are filtered, sterile and biologically free from contaminants. Since the flow of gas or air is maintained at pressure greater than atmospheric pressure, any contaminated material is driven away from the exposed openings of the sterile components. In this way, the original sterilized state of the components is maintained.

Furthermore, the integrity of the filters supplying the sterile air or gas may be checked at any time by simply using the air drop test apparatus 120 and the quick disconnect fittings 112A, 112B and 112C provided on the upstream side of each of the gas filters 111A, 111B and 111C. Moreover, since air or gas is used to provide the principal means of maintaining the sterilized condition of the apparatus, potentially or relatively dangerous high temperature steam is only used during the initial sterilization step. This reduces the danger of burns when the machine is operating. Finally, the unique three-position two-way valves used on either sides of the gas filters 111A, 111B, and 111C allows the various connections and lines to be sterilized without leaving stagnant pockets or cavities which could become a potential source of contamination.

Thus, from the foregoing description and the appended drawings, it should be evident that the present invention provides an improved apparatus for sterilizing a liquid packaging machine. Although the present invention has been described in conjunction with only one preferred embodiment, it should be understood that various modifications in structure may be used without departing from spirit and essential characteristics of the invention. Accordingly, all such modifications are to be included within the scope of the appended claims.

What is claimed is as follows:

1. In a liquid packaging system having (1) a metering device that includes a cylinder, a piston rod with an end disposed in said cylinder, and a shifting piston connected to said rod end and slidably disposed in said cylinder; said piston having a pressurizing side and an oppositely facing piston rod side that is connected to said piston rod; said metering device having a dosing chamber defined by said cylinder and said piston pressurizing side and (2) a source of sterilizing agent communicating with the piston rod side of said piston; a system for preventing the entry of contaminants into the piston rod side of said metering device cylinder, said system comprising:

(a) valve means communicating with said cylinder on said piston rod side of said metering device for passing flow of said sterilizing agent out of said cylinder on said piston rod side of said piston whereby, upon the application of sterilizing agent from said source to said cylinder at said piston rod side of said piston and upon the opening of said valve means, said agent flows through said cylinder on said piston rod side of said piston thereby sterilizing said piston rod side of said cylinder; and (b) means for furnishing a supply of filtered gas under pressure to said piston rod side of said cylinder after said piston rod side of said cylinder has been sterilized by said sterilizing agent and after said valve means is shut whereby the gas supplied to said cylinder flows out of said cylinder around said piston rod thereby precluding the entry of the contaminants into said cylinder and dosing chamber around said piston rod and piston after sterilization.

2. The system set forth in claim 1, wherein said valve means is a relief valve and wherein said filtered gas furnishing means includes means for furnishing said filtered gas at a pressure in excess of the pressure set point of said relief valve.

* * * * *